US008147265B2

(12) United States Patent
Chiu

(10) Patent No.: US 8,147,265 B2
(45) Date of Patent: Apr. 3, 2012

(54) CARD EDGE CONNECTOR AND LATCH THEREOF

(75) Inventor: Richard Chiu, Taoyuan (TW)

(73) Assignee: FCI, Versailles (FR)

( * ) Notice: Subject to any disclaimer, the term of this patent is extended or adjusted under 35 U.S.C. 154(b) by 291 days.

(21) Appl. No.: 12/309,093

(22) PCT Filed: Jul. 10, 2007

(86) PCT No.: PCT/EP2007/006112

§ 371 (c)(1),
(2), (4) Date: Jun. 15, 2009

(87) PCT Pub. No.: WO2008/006549

PCT Pub. Date: Jan. 17, 2008

(65) Prior Publication Data

US 2010/0022114 A1 Jan. 28, 2010

(30) Foreign Application Priority Data

Jul. 10, 2006 (TW) ..... 95125096 A

(51) Int. Cl.
*H01R 13/62* (2006.01)

(52) U.S. Cl. ..... 439/328; 439/160

(58) Field of Classification Search ..... 439/328, 439/152, 157, 160

See application file for complete search history.

(56) References Cited

U.S. PATENT DOCUMENTS

| | | | | |
|---|---|---|---|---|
| 5,364,282 | A | 11/1994 | Tondreault | 439/157 |
| 5,511,985 | A | 4/1996 | Noschese et al. | 439/157 |
| 6,132,228 | A | 10/2000 | Lang | 439/160 |
| 6,200,149 | B1 | 3/2001 | Chi-Chung | 439/160 |
| 6,244,879 | B1 * | 6/2001 | Liu | 439/152 |
| 6,368,126 | B1 * | 4/2002 | Lee | 439/160 |
| 6,390,837 | B1 * | 5/2002 | Lee | 439/160 |
| 2003/0148646 | A1 | 8/2003 | Frantum, Jr. et al. | 439/157 |

FOREIGN PATENT DOCUMENTS

TW 280015 11/2005

OTHER PUBLICATIONS

English language abstract of CN-2800535 Jul. 26, 2006 Foxconn Kunshan Comp Interface (CN) Which corresponds to TW-280015.

* cited by examiner

*Primary Examiner* — Tulsidas C Patel
*Assistant Examiner* — Travis Chambers
(74) *Attorney, Agent, or Firm* — Harrington & Smith

(57) ABSTRACT

This invention relates to a card edge connector and a latch thereof. The connector is used to receive a printed circuit card and includes a housing having two opposite ends, a card slot disposed between two opposite ends. The housing has a first width. The latch as a latch body portion, pivotally mounted on two ends of the housing for ejecting the card, and at least one through hole and a second width. The latch further has a latch head portion, extending from the body portion for latching the card, having at least one through hole and a third width. The second and third widths are substantially the same, and are smaller than the first width of the housing for improving heat dissipation.

20 Claims, 4 Drawing Sheets

CARD EDGE CONNECTOR AND LATCH THEREOF

FIELD OF THE INVENTION

The present invention relates to a card edge connector and a latch thereof, and more particularly to a card edge connector and a latch thereof capable of improving heat dissipation.

BACKGROUND OF THE INVENTION

Electrical connectors generally refer to connection elements and accessories applied to electronic signals and power sources. An extensive definition of connector further includes receptacles, plugs, cable erection, and the like. In view of electronic packaging, a connector is an element with interconnection parts that can be engaged/disengaged or replaced. In other words, the connector is a bridge between all signals, so the property of the connector influences an operation quality of the entire electronic system.

A card edge connector is disposed on a main circuit card of an electronic apparatus, for various modular electronic cards or printed circuit cards to insert, so as to achieve an electrical conduction between the electronic card and the main circuit card, thereby expanding the performance of the main circuit card.

In recent years, the speed of CPU is continuously increased, from the early 33 MHz, 66 MHz, to Pentium III 500 MHz, and to the latest Pentium 4 3.06 GHz, and the electronic signal transmission speed of motherboard and computer peripherals is increased accordingly. Therefore, high frequency electrical characteristic of the electronic connector responsible for a bridge for electronic signal transmission becomes an important subject for electronic connector manufacturers.

However, high frequency signal transmission always means high power consumption, and high power consumption easily incurs problems of undesirable heat generation and accumulation. The working environment of high temperature always influences the working efficiency of electronic elements, thereby reducing the life time of the electronic elements.

Therefore, it can be predicted that in future heat dissipation problem must be an important subject for high frequency card edge connectors.

FIG. 1 is a schematic view of a conventional card edge connector before being combined with a circuit card, and FIG. 2 is a schematic view of the conventional card edge connector after being combined with the circuit card. As shown in FIGS. 1 and 2, the conventional card edge connector 100 includes a housing 110 having two opposite ends 111, 112 and a card slot 113 disposed between the two opposite ends 111, 112. A latch 120 is disposed on each end 111, 112. A printed circuit card 200 can be inserted in the card slot 113, and a latch 120 is used to latch or eject the printed circuit card 200. The latch 120 includes a body portion 121 and a head portion 122. The body portion 121 is pivotally mounted on respective ends 111, 112 of the housing 110, and ejects the circuit card 200 by pivoting. The head portion 122 extends from the body portion 121 for latching and positioning the circuit card 200.

After the circuit card 200 is inserted in the card edge connector 100, due to the characteristic of high-speed transmission of the current connector or the influence of high-speed operation of the modular circuit card itself, a heat dissipation fan is usually disposed above or beside the circuit card 200 to avoid accumulation of heat. However, as a plurality of connectors of this type is disposed in parallel closely, no matter the heat dissipation fan is disposed above or at side edge of the circuit card 200, the airflow mainly advances along the direction of arrow A in FIG. 2. That is to say, the heat is carried away mainly along this direction.

However, due to the disposal of the two ends 111, 112 and the latch 120 of the card edge connector 100, the heat dissipation airflow is often blocked before reaching the two ends 111, 112 of the connector 100, such that heat is accumulated at the two ends 111, 112 and cannot be effectively dissipated. Therefore, the temperature of working environment of the circuit card 200 and the card edge connector 100 is increased, thus influencing the working efficiency and lifespan.

SUMMARY OF THE INVENTION

The present invention is directed to providing a card edge connector and a latch thereof, which uses an improved structure of the latch to advance heat dissipation efficiency of the card edge connector.

In order to achieve the above objective, in one embodiment, a card edge connector includes a housing having two opposite ends and a card slot disposed between the two opposite ends, in which the card slot is used for receiving a printed circuit card, and a latch is disposed on each of the two opposite ends. The two opposite ends of the housing have a first width.

The latch includes a body portion and a head portion. The body portion is pivotally mounted on a respective end of the housing, for ejecting the printed circuit card inserted in the card slot. The body portion has at least one through hole and a second width, and the second width is smaller than the first width. The head portion extends from the body portion to latch the printed circuit card inserted in the card slot, and the head portion has at least one through hole and a third width, and the third width is smaller than the first width.

The second width of the body portion can be designed to be equal to the third width of the head portion.

DETAILED DESCRIPTION

Figure 1:
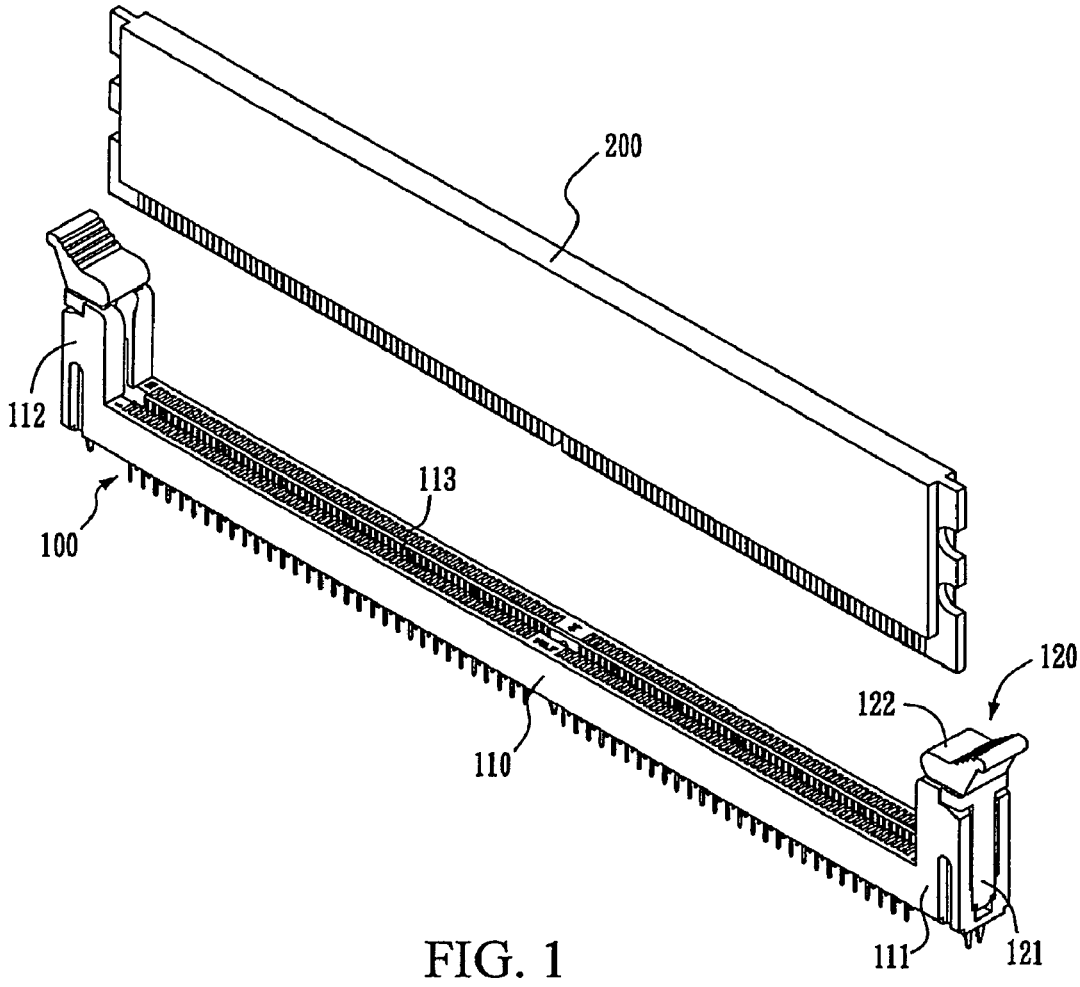
FIG. 1 is a schematic view of a conventional card edge connector before being combined with a circuit card.
Figure 2:
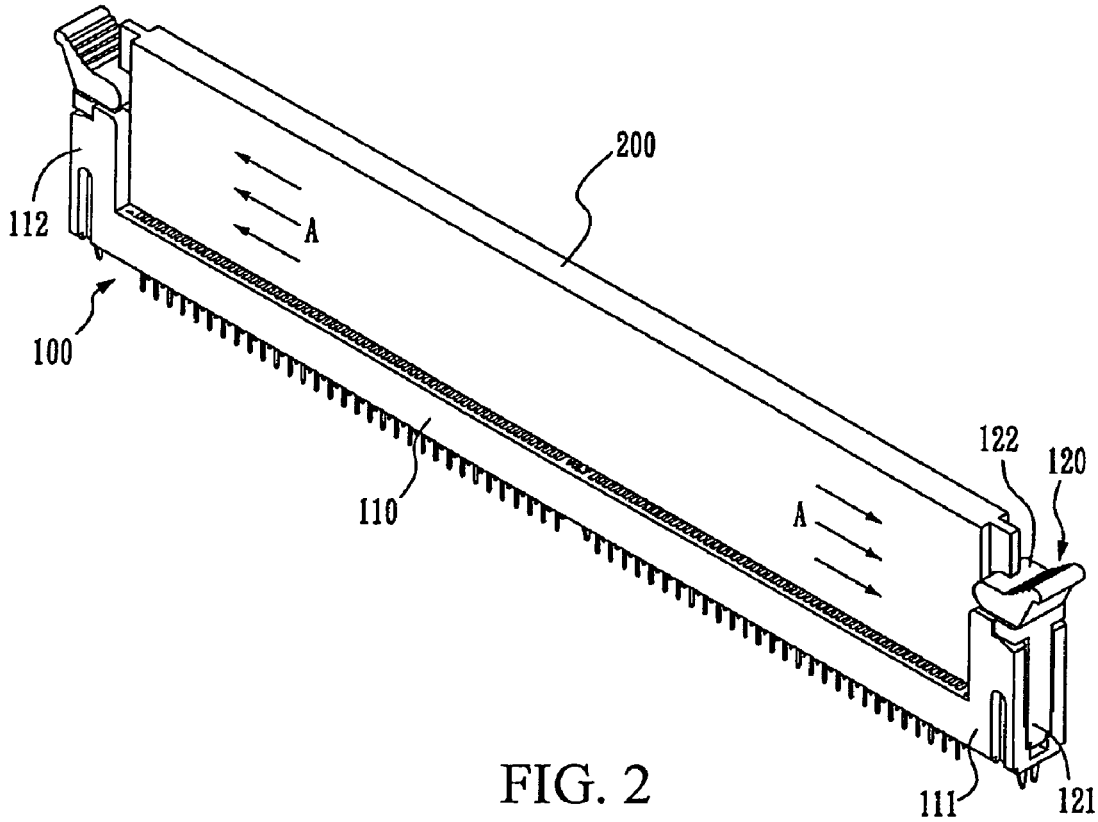
FIG. 2 is a schematic view of the conventional card edge connector after being combined with the circuit card.

Preferred embodiments of the present invention will be illustrated with reference to drawings as follows, and reference numerals in the drawings are used to indicate corresponding elements.

Figure 3:
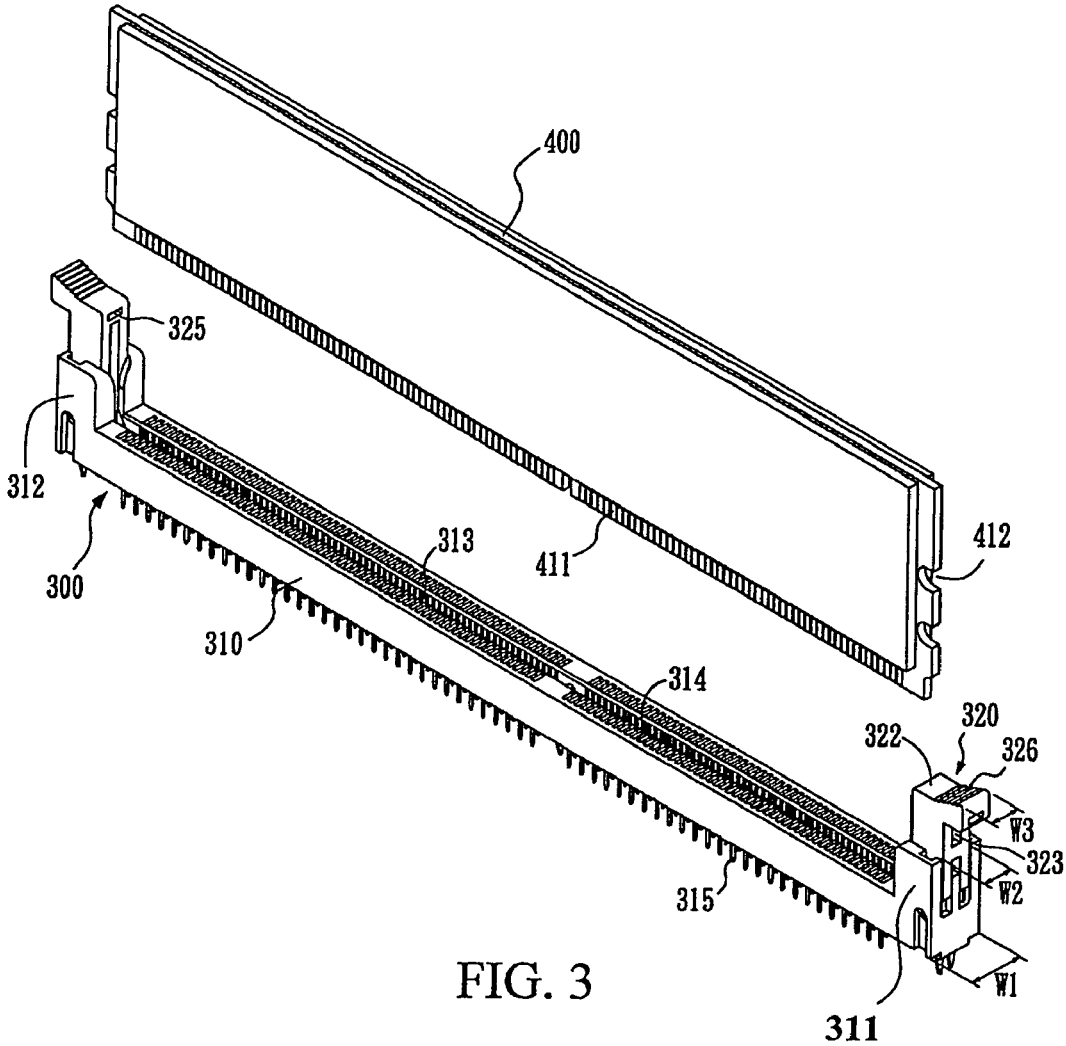
FIG. 3 is a schematic view of a card edge connector of one embodiment of the present invention before being combined with a circuit card.
Figure 4:
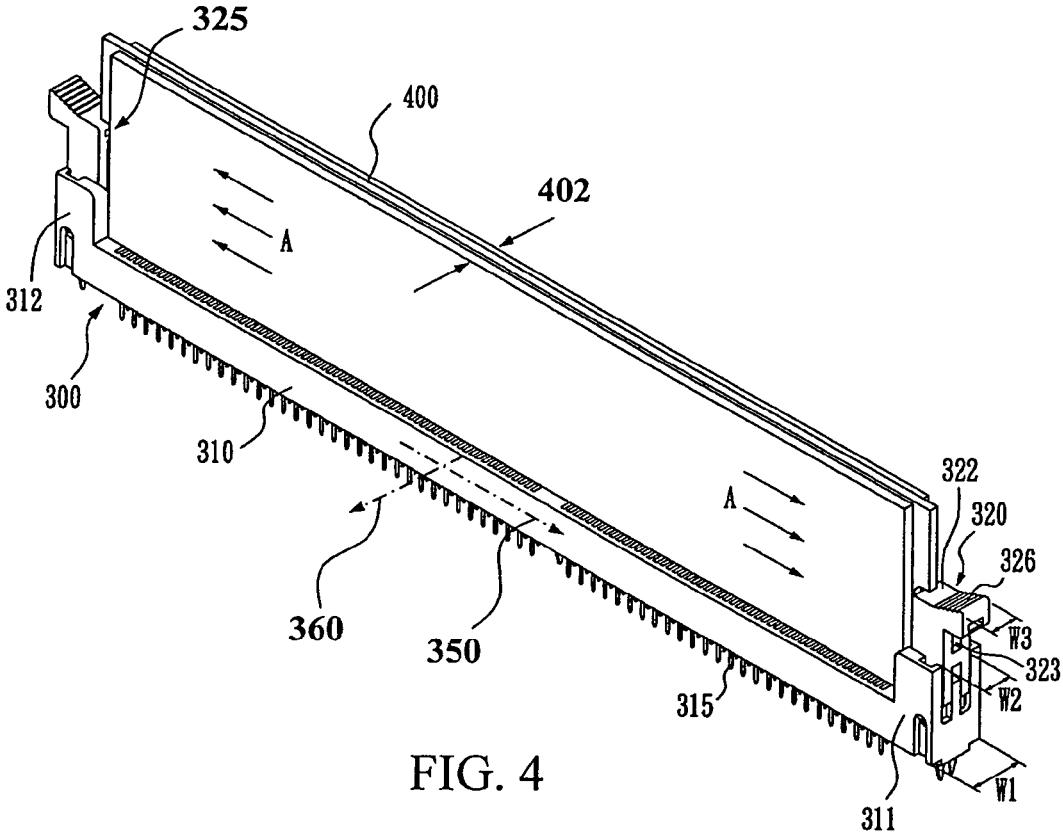
FIG. 4 is a schematic view of the card edge connector shown in FIG. 3 after being combined with the circuit card.
Figure 5:
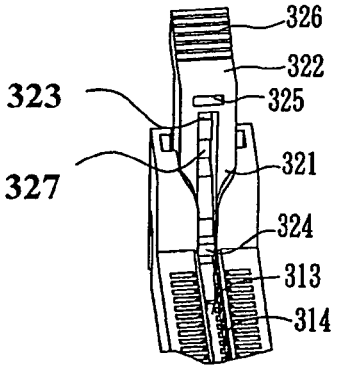
FIG. 5 is a schematic view of showing a latch of one embodiment of the present invention.

FIG. 3 is a schematic view of a card edge connector of one embodiment of the present invention before being combined with a circuit card. FIG. 4 is a schematic view of the card edge connector shown in FIG. 3, after being combined with the circuit card. FIG. 5 is a schematic view of a latch of one embodiment of the present invention. As shown in the figures, the card edge connector 300 is generally disposed on a main circuit card (not shown), for receiving and fixing a printed circuit card or sub-circuit card 400, thereby forming an electrical connection between the main circuit card and the sub-circuit card 400, so as to expand the function of the main circuit card.

The card edge connector 300 includes a housing 310 having two opposite ends 311, 312 and a card slot 313 disposed between the two opposite ends 311, 312. The two opposite ends 311, 312 of the housing 310 have a first width W1. The card slot 313 is used for the circuit card 400 to insert, and a plurality of conductive terminals 314 are disposed in the card slot 313. Each conductive terminal 314 extends at the bottom of the housing 310 to form a pin 315. The card edge connector 300 can be fixed on the main circuit card by bonding (e.g., soldering) each pin 315 on the main circuit card.

A latch 320 is disposed on each of the two opposite ends 311, 312 of the housing 310, and is used to latch or eject the circuit card 400 inserted in the card slot 313. The latch 320 includes a body portion 321 and a head portion 322. The body portion 321 is pivotally mounted on each end 311, 312 of the housing 310, and the body portion 321 has at least one through hole 323 and a protrusion 324. In an alternative embodiment, body portion 321 may have a slot or opening 327. The head portion 322 extends from the body portion 321 (FIG. 5), and has at least one through hole 325 and a pressing portion 326 disposed thereon. Through holes 323, 325 and slot 327 are disposed along a longitudinal direction 350 of housing 310, and has a dimension along a lateral direction 360 which is greater than the thickness 402 of sub-circuit card 400. When sub-circuit card 400 is inserted and fixed in housing 310, through hole 323 or 325 or slot 327 is partially exposed, forming an air-passage to allow air coming from sub-circuit card 400 to pass through, as shown more clearly in FIG. 4.

The body portion 321 has a second width W2, and the second width W2 is smaller than the first width W1 of the two opposite ends 311, 312 of the housing 310. The head portion 322 has a third width W3, and the third width W3 is also smaller than the first width W1 of the two opposite ends 311, 312 of the housing 310. The second width W2 and the third width W3 can be in any relationship. For example, the second width W2 can be larger than or smaller than the third width W3. In one preferred embodiment, the second width W2 is the same as the third width W3.

The sub-circuit card 400 has a plurality of gold fingers 411 disposed at one end corresponding to the card slot 313, and has one or more notches 412 respectively disposed at two sides corresponding to the latch 320.

When inserting the sub-circuit card 400 in the card edge connector 300, a user first presses the pressing portion 326 on the head portion 322 of the latch 320, such that the latch 320 pivotally mounted on two ends 311, 312 of the housing 310 pivotally rotates outward. The gold fingers 411 of the sub-circuit card 400 are inserted in the card slot 313 of the card edge connector 300, such that the gold fingers 411 are in contact with the conductive terminals 314 in the card slot 313 to form electrical conduction.

At this time, the protrusion 324 of the latches 320 is pushed by the sub-circuit card 400 when being inserted, so that the latch 320 pivotally rotates back inward, such that the notches 412 at two sides of the sub-circuit card 400 are engaged with the head portion 322 of the latch 320, thereby the sub-circuit card 400 is latched on the card edge connector 300 (as shown in FIG. 4).

When the sub-circuit card 400 operates, a heat dissipation fan can be disposed above or beside the sub-circuit card 400, so as to improve heat dissipation efficiency by forced convection. At this time, the direction of the heat dissipation airflow is marked by arrow A in FIG. 4. The second width W2 of the body portion 321 is smaller than the first width W1 of the two opposite ends 311, 312 of the housing 310, and the third width W3 of the head portion 322 is smaller than the first width W1 of the two opposite ends 311, 312 of the housing 310. Therefore, the airflow when flowing to the two ends 311, 312 of the card edge connector 300 is not likely to be blocked by the latch 320. Further, the body portion 321 and the head portion 322 respectively have at least one through hole 323, 325, which can also increase the amount of airflow, thereby greatly improve the overall heat dissipation efficiency.

If it is intended to take the sub-circuit card 400 out of the card edge connector 300, the pressing portion 326 on the head portion 322 is pressed again, such that the latch 320 pivotally rotates outward, thereby the head portion 322 of the latch 320 is released from the engagement with the notches 412 of the sub-circuit card 400. Meanwhile, through the pivotal rotation of the body portion 321, the protrusion 324 on the body portion 321 pushes the sub-circuit card 400 to be ejected upward, thereby releasing the sub-circuit card 400 from the card edge connector 300. In this manner, the sub-circuit card 400 can be taken out from the card edge connector 300.

It will be apparent to those skilled in the art that various modifications and variations can be made to the structure of the present invention without departing from the scope or spirit of the invention. For example, through holes, slot and a narrowed width configuration may not be present simultaneously in a latch. A latch having a narrowed width, or with the same width as the connector housing but with one or more through holes/slots/opening may well be advantageously implemented in a card connector, for better air-flow control and heat dissipation. In view of the foregoing, it is intended that the present invention cover modifications and variations of this invention provided they fall within the scope of the following claims and their equivalents.

LIST OF REFERENCE NUMERALS

100, 300 card edge connector
110, 310 housing
111, 112, 311, 312 end
113, 313 card slot
120, 320 latch
121, 321 body portion
122, 322 head portion
200, 400 sub-circuit card/printed circuit card
314 conductive terminal
315 pin
323, 325 through hole
324 protrusion
326 pressing portion
327 Opening/slot
350 longitudinal direction of housing 310
360 lateral direction of housing 310
402 thickness of sub-circuit card 400
411 gold finger
412 notch
W1 first width
W2 second width
W3 third width

The invention claimed is:

1. A latch of a card edge connector, for latching/ejecting a printed circuit card to/from the card edge connector, the card edge connector comprises a housing having two opposite ends and a card slot disposed between the two opposite ends for receiving the printed circuit card, and the two opposite ends of the housing have a first width, the latch comprising:

a body portion, which is sized and shaped to be pivotally mounted on one of the ends of the housing, for ejecting the printed circuit card inserted in the card slot, the body portion having a second width smaller than the first width, where the body portion comprises a side edge slot adapted to receive a side edge of the printed circuit card; and a head portion, extending from the body portion for latching the printed circuit card inserted in the card slot, the head portion having a third width smaller than the first width, where the head portion is located above the side edge slot, and where the head portion has at least one through hole along a longitudinal direction of the housing which is spaced from the side edge slot.

2. The latch as claimed in claim 1, wherein the second width is the same as the third width.

3. The latch as claimed in claim 1, wherein the body portion has at least one through hole along a longitudinal direction of the housing.

4. The latch as claimed in claim 1, wherein the body portion has at least one opening along a longitudinal direction of the housing.

5. The latch as claimed in claim 1, wherein a leading edge of the head portion is adapted to be inserted into a notch in the side edge of the printed circuit card, where the through hole is located in the head portion to be located in the notch and extend outward past front and rear sides of the printed circuit card at the notch.

6. The latch as claimed in claim 1, wherein the through hole is wider than the side edge slot.

7. A latch of a card edge connector, for latching/ejecting a printed circuit card to/from the card edge connector, the card edge connector comprises a housing having two opposite ends and a card slot disposed between the two opposite ends for receiving the printed circuit card, the latch comprising:

a body portion, adapted to be pivotally mounted on one of the ends of the housing, the body portion having at least one opening along a longitudinal direction of the housing, where the body portion comprises a side edge slot for receiving a side edge of the printed circuit card; and a head portion, extending from the body portion for latching the printed circuit card inserted in the card slot, where the head portion is located above the side edge slot where the head portion has at least one through hole along the longitudinal direction, and where the through hole is wider than the side edge slot.

8. The latch as claimed in claim 7, wherein the body portion has at least one through hole along the longitudinal direction.

9. The latch as claimed in claim 7, wherein a leading edge of the head portion is adapted to be inserted into a notch in the side edge of the printed circuit card, where the through hole is located in the head portion to be located in the notch and extend outward past front and rear sides of the printed circuit card at the notch.

10. The latch as claimed in claim 9, wherein the through hole is spaced from the side edge slot.

11. A latch of a card edge connector, for latching/ejecting a printed circuit card to/from the card edge connector, the card edge connector comprises a housing having two opposite ends and a card slot disposed between the two opposite ends for receiving the printed circuit card, the latch comprising:

a body portion, adapted to be pivotally mounted on one of the ends of the housing, where the body portion comprises a side edge slot for receiving a side edge of the printed circuit card; and a head portion, extending from the body portion for latching the printed circuit card inserted in the card slot, the head portion having a through hole along a longitudinal direction of the housing, where the head portion is located above the side edge slot where the through hole is spaced from the side edge slot, and where the through hole is wider than the side edge slot.

12. The latch as claimed in claim 11, wherein a leading edge of the head portion is adapted to be inserted into a notch in the side edge of the printed circuit card, where the through hole is located in the head portion to be located in the notch and extend outward past front and rear sides of the printed circuit card at the notch.

13. A card edge connector, for receiving a printed circuit card, comprising:

a housing, having two opposite ends and a card slot disposed between the two opposite ends for receiving the printed circuit card and the housing having a first width;

a latch comprising a latch body portion, pivotally mounted on one of the ends of the housing, for ejecting the printed circuit card inserted in the card slot, the body portion having a second width smaller than the first width, where the body portion comprises a side edge slot for receiving a side edge of the printed circuit card; and a latch head portion, extending from the latch body portion for latching the printed circuit card inserted in the card slot, the head portion having a third width smaller than the first width, where the latch head portion has at least one through hole along a longitudinal direction of the housing, where the head portion is located above the side edge slot, and where the through hole is wider than the side edge slot.

14. The card edge connector as claimed in claim 13, wherein the second width is the same as the third width.

15. The card edge connector as claimed in claim 13, wherein the latch body portion has at least one opening along a longitudinal direction of the housing.

16. The card edge connector as claimed in claim 13, wherein the latch body portion has at least one through hole along a longitudinal direction of the housing.

17. The card edge connector as claimed in claim 13 wherein a leading edge of the head portion is adapted to be inserted into a notch in the side edge of the printed circuit card, where the through hole is located in the head portion to be located in the notch and extend outward past front and rear sides of the printed circuit card at the notch.

18. The card edge connector as claimed in claim 17 where the through hole is spaced from the side edge slot.

19. A card edge connector, for receiving a printed circuit card, comprising:

a housing, having two opposite ends and a card slot disposed between the two opposite ends for receiving the printed circuit;

a latch comprising a latch body portion, pivotally mounted on one of the ends of the housing, for ejecting the printed circuit card inserted in the card slot, the body portion having at least one opening along a longitudinal direction of the housing adapted to receive a side edge of the printed circuit card, and a latch head portion, extending from the latch body portion for latching the printed circuit card inserted in the card slot, where the latch head portion has at least one through hole along the longitudinal direction, where the head portion is located above the side edge slot, and where the through hole is spaced from the side edge slot.

20. The card edge connector as claimed in claim 19, wherein the latch body portion has at least one through hole along the longitudinal direction.

* * * * *